US010472210B2

(12) United States Patent
Zafiris et al.

(10) Patent No.: US 10,472,210 B2
(45) Date of Patent: Nov. 12, 2019

(54) LOAD BEARING MEMBER FOR AN ELEVATOR SYSTEM HAVING A METALIZED POLYMER COATING

(71) Applicant: Otis Elevator Company, Farmington, CT (US)

(72) Inventors: Georgios S. Zafiris, Glastonbury, CT (US); Paul Papas, West Hartford, CT (US); Daniel A. Mosher, Glastonbury, CT (US); Scott A. Eastman, Glastonbury, CT (US); Zhongfen Ding, South Windsor, CT (US); Brad Guilani, Woodstock Valley, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 0 days.

(21) Appl. No.: 15/345,039

(22) Filed: Nov. 7, 2016

(65) Prior Publication Data

US 2018/0127239 A1 May 10, 2018

(51) Int. Cl.

| | |
|---|---|
| ***B66B 7/06*** | (2006.01) |
| ***B05D 1/26*** | (2006.01) |
| ***B66B 9/00*** | (2006.01) |
| ***D07B 1/22*** | (2006.01) |

(52) U.S. Cl.

CPC ..... *B66B 7/062* (2013.01); *B05D 1/265* (2013.01); *B66B 9/00* (2013.01); *D07B 1/22* (2013.01); *D07B 2501/2007* (2013.01)

(58) Field of Classification Search

CPC ..... B66B 7/062; B66B 9/00; B05D 1/265

See application file for complete search history.

(56) References Cited

U.S. PATENT DOCUMENTS

| | | | | |
|---|---|---|---|---|
| 7,086,217 | B2 * | 8/2006 | Eichhorn | D07B 1/162 57/241 |
| 8,479,887 | B2 | 7/2013 | Yu et al. | |
| 9,050,768 | B2 | 6/2015 | Urbani et al. | |
| 9,126,805 | B2 | 9/2015 | Pelto-Huikko et al. | |
| 9,328,798 | B2 | 5/2016 | Lotz et al. | |
| 9,873,593 | B2 * | 1/2018 | Papas | B66B 7/062 |

(Continued)

FOREIGN PATENT DOCUMENTS

| | | |
|---|---|---|
| CN | 201220837 Y | 4/2009 |
| CN | 201386757 Y | 1/2010 |

(Continued)

OTHER PUBLICATIONS

EP2913288—Machine Translation (Year: 2015).*

European Search Report Issued in EP Appliation No. 17200332.9, dated May 8, 2018, 9 Pages.

*Primary Examiner* — Michael A Riegelman

(74) *Attorney, Agent, or Firm* — Cantor Colburn LLP

(57) ABSTRACT

A belt for an elevator system is provided. The belt includes a plurality of tension members arranged along a belt width. A jacket material at least partially encapsulates the plurality of tension members. The jacket material includes a traction surface and a back surface opposite the traction surface together defining a belt thickness therebetween. The jacket material also includes two end surfaces extending between the traction surface and the back surface and defining the belt width therebetween. A metalized polymer coating layer is disposed over at least one of the two end surfaces.

8 Claims, 4 Drawing Sheets

(56) References Cited

U.S. PATENT DOCUMENTS

2010/0133046 A1 6/2010 Allwardt et al.
2010/0240482 A1* 9/2010 Kanzow ..... F16G 5/08 474/237
2011/0100759 A1* 5/2011 Yu ..... B66B 7/062 187/251
2011/0108372 A1* 5/2011 Krishnan ..... B66B 7/062 187/411
2011/0259677 A1* 10/2011 Dudde ..... B66B 7/062 187/411
2012/0329591 A1* 12/2012 Goeser ..... B66B 7/062 474/238
2013/0171463 A1* 7/2013 Chang ..... B66B 7/062 428/549
2014/0015168 A1* 1/2014 Krishnan ..... B29C 63/22 264/279
2014/0027211 A1 1/2014 Wesson et al.
2014/0302316 A1* 10/2014 Gallens ..... B66B 7/062 428/379
2015/0079331 A1* 3/2015 Hung ..... B05D 3/0263 428/76
2015/0087456 A1 3/2015 Baltes et al.
2015/0191331 A1* 7/2015 Orelup ..... D07B 1/22 428/76
2015/0259176 A1* 9/2015 Goeser ..... B66B 7/062 428/189
2016/0325966 A1* 11/2016 Papas ..... B66B 7/062
2017/0283219 A1* 10/2017 Ding ..... B29D 29/00
2017/0283220 A1* 10/2017 Ding ..... B66B 7/062
2017/0284503 A1* 10/2017 Goser ..... B66B 7/062

FOREIGN PATENT DOCUMENTS

CN 201546108 U 8/2010
DE 29924758 U1 7/2005
EP 2913288 A1 9/2015
WO 2016030298 A1 3/2016
WO 2017172886 A1 10/2017
WO 2017172891 A1 10/2017

* cited by examiner

LOAD BEARING MEMBER FOR AN ELEVATOR SYSTEM HAVING A METALIZED POLYMER COATING

TECHNICAL FIELD OF THE EMBODIMENTS

Embodiments disclosed herein relate to elevator systems, and more particularly, to coating of a load bearing member having a metalized polymer coating for use in an elevator system.

BACKGROUND OF THE EMBODIMENTS

Elevator systems are useful for carrying passengers, cargo, or both, between various levels in a building. Some elevators are traction based and utilize load bearing members such as ropes or belts for supporting the elevator car and achieving the desired movement and positioning of the elevator car.

Where ropes are used as load bearing members, each individual rope is not only a traction device for transmitting the pulling forces but also participates directly in the transmission of the traction forces. Where belts are used as a load bearing member, a plurality of tension elements are embedded in a common elastomer belt body. The tension elements are exclusively responsible for transmitting the pulling forces, while the elastomer material transmits the traction forces. In some belts, the tension members are cords formed from a plurality of elements such as steel wires, while in other belts the tension members may be formed from unidirectional fibers arranged in a rigid matrix composite, providing significant benefits when used in elevator systems, particularly high rise systems. Fire resistance is an important safety element associated with belt performance.

SUMMARY OF THE EMBODIMENTS

In one aspect, a belt for an elevator system is provided. The belt includes a plurality of tension members arranged along a belt width. A jacket material at least partially encapsulates the plurality of tension members. The jacket material includes a traction surface and a back surface opposite the traction surface together defining a belt thickness therebetween. The jacket material also includes two end surfaces extending between the traction surface and the back surface and defining the belt width therebetween. A metalized polymer coating layer is disposed over at least one of the two end surfaces.

In an aspect of the above, the metalized polymer coating layer is further disposed over at least a portion of at least one of the traction surface or the back surface.

In an aspect of any of the above, the metalized polymer coating layer includes, without limitation, at least one of polyurethane, nitrile rubber, polybutadiene rubber, styrene-butadiene rubber, ethylene propylene rubber, ethylene propylene diene rubber, fluorosilicone rubber, silicone rubber, fluoroelastomer, polyethylene terephthalate, polyester, polyolefin, chloroprene, polyvinyl chloride, or other polymer, or thermoplastic elastomer, or thermosetting elastomer, or a ductile metal.

In an aspect of any of the above, the metalized polymer coating layer includes a ductile metal.

In an aspect of any of the above, the metalized polymer coating layer is applied to the jacket material through melt adhesion.

In an aspect of any of the above, the metalized polymer coating layer is applied to the jacket material through extrusion.

In an aspect of any of the above, the jacket material comprises a groove, and the metalized polymer coating layer comprises a tongue interlocked within the groove.

In one aspect, an elevator system is provided having an elevator car and a counterweight. A belt couples the elevator car to the counterweight. The belt includes a plurality of tension members arranged along a belt width. A jacket material at least partially encapsulates the plurality of tension members. The jacket material includes a traction surface and a back surface opposite the traction surface together defining a belt thickness therebetween. The jacket material also includes two end surfaces extending between the traction surface and the back surface and defining the belt width therebetween. A metalized polymer coating layer is disposed over at least one of the two end surfaces.

In an aspect of the above, the metalized polymer coating layer is further disposed over at least a portion of at least one of the traction surface or the back surface.

In an aspect of any of the above, the metalized polymer coating layer includes, without limitation, at least one of polyurethane, nitrile rubber, polybutadiene rubber, styrene-butadiene rubber, ethylene propylene rubber, ethylene propylene diene rubber, fluorosilicone rubber, silicone rubber, fluoroelastomer, polyethylene terephthalate, polyester, polyolefin, chloroprene, polyvinyl chloride, or other polymer, or thermoplastic elastomer, or thermosetting elastomer, or a ductile metal.

In an aspect of any of the above, the metalized polymer coating layer includes a ductile metal.

In an aspect of any of the above, the metalized polymer coating layer is applied to the jacket material through melt adhesion.

In an aspect of any of the above, the metalized polymer coating layer is applied to the jacket material through extrusion.

In an aspect of any of the above, the jacket material includes a groove, and the metalized polymer coating layer comprises a tongue interlocked within the groove.

In one aspect, a method of forming a belt for an elevator system is provided. The method includes extending a plurality of tension members along a belt width. The method also includes at least partially encapsulating the plurality of tension members with a jacket material having a traction surface and a back surface opposite the traction surface together defining a belt thickness therebetween. The jacket material also has two end surfaces extending between the traction surface and the back surface and defining the belt width therebetween. The method also includes disposing a metalized polymer coating layer over at least one of the two end surfaces.

In an aspect of the above, the metalized polymer coating layer is disposed over at least a portion of at least one of the traction surface or the back surface.

In an aspect of any of the above, the method also includes forming the metalized polymer coating layer from, without limitation, at least one of polyurethane, nitrile rubber, polybutadiene rubber, styrene-butadiene rubber, ethylene propylene rubber, ethylene propylene diene rubber, fluoro silicone rubber, silicone rubber, fluoroelastomer, polyethylene terephthalate, polyester, polyolefin, chloroprene, polyvinyl chloride, or other polymer, or thermoplastic elastomer, or thermosetting elastomer, or a ductile metal.

In an aspect of any of the above, the method also includes applying the metalized polymer coating layer to the jacket material through melt adhesion.

In an aspect of any of the above, the method also includes applying the metalized polymer coating layer to the jacket material through extrusion.

In an aspect of any of the above, the method also includes forming a groove in the jacket material, and forming a tongue in the metalized polymer coating layer. The method also includes interlocking the tongue within the groove.

DETAILED DESCRIPTION OF THE DRAWINGS

Figure 1:
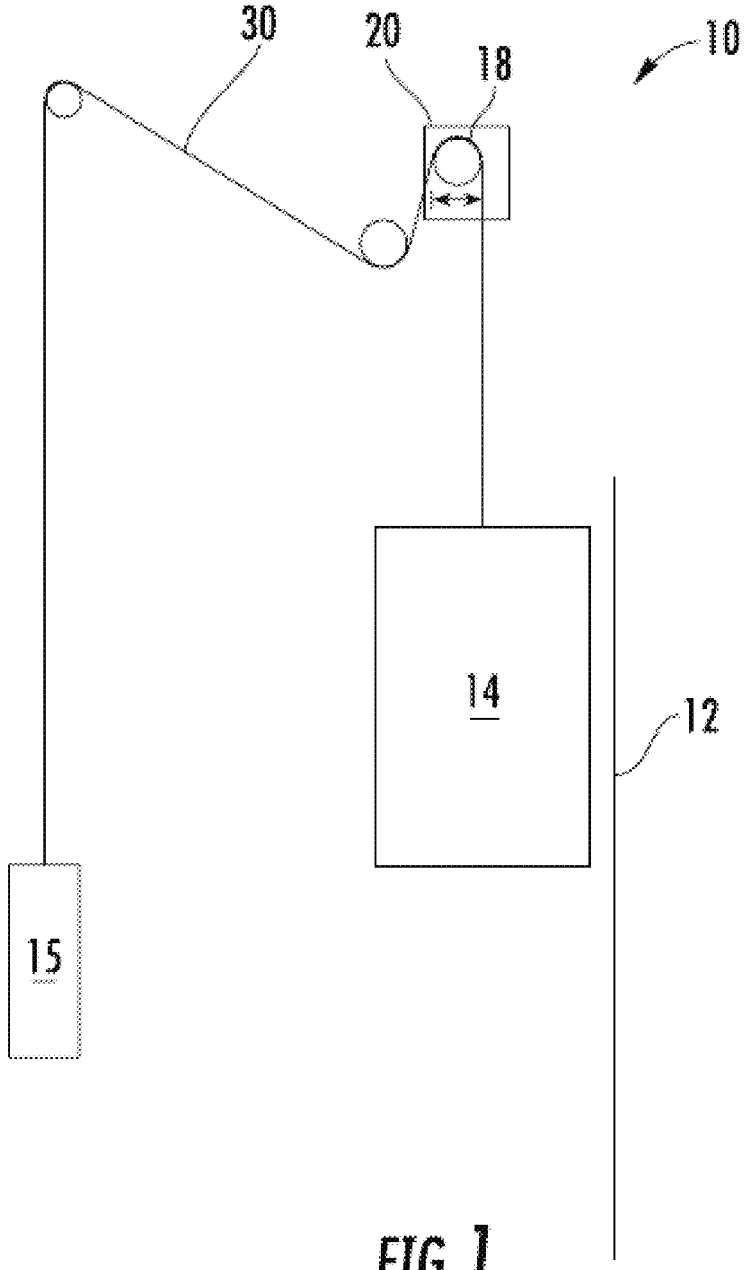
FIG. 1 is a perspective view of an example of a traction elevator system.

Referring now to FIG. 1, an exemplary embodiment of an elevator system 10 is illustrated. The elevator system 10 includes an elevator car 14 configured to move vertically upwardly and downwardly within a hoistway 12 along a plurality of car guide rails (not shown). Guide assemblies mounted to the top and bottom of the elevator car 14 are configured to engage the car guide rails to maintain proper alignment of the elevator car 14 as it moves within the hoistway 12.

The elevator system 10 also includes a counterweight 15 configured to move vertically upwardly and downwardly within the hoistway 12. The counterweight 15 moves in a direction generally opposite the movement of the elevator car 14 as is known in conventional elevator systems. Movement of the counterweight 15 is guided by counterweight guide rails (not shown) mounted within the hoistway 12. In the illustrated, non-limiting embodiment, at least one load bearing member 30, for example, a belt, coupled to both the elevator car 14 and the counterweight 15 cooperates with a traction sheave 18 mounted to a drive machine 20. To cooperate with the traction sheave 18, at least one load bearing member 30 bends in a first direction about the traction sheave 18. Although the elevator system 10 illustrated and described herein has a 1:1 roping configuration, elevator systems 10 having other roping configurations and hoistway layouts are within the scope of the present disclosure.

Figure 2:
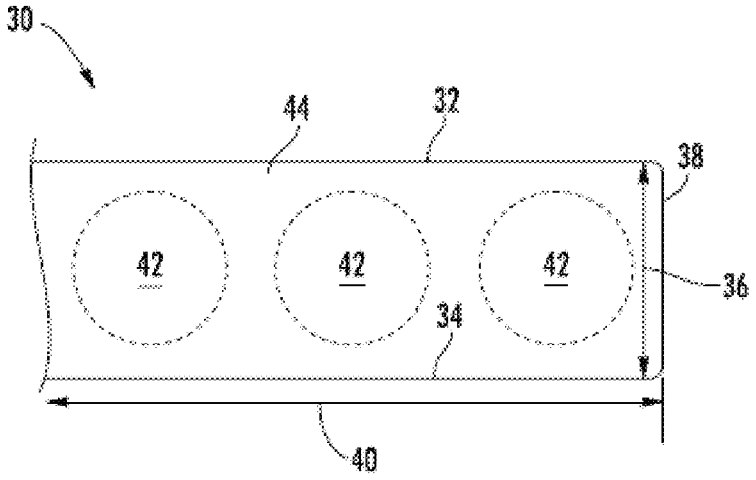
FIG. 2 is a cross-sectional view of an exemplary embodiment of a belt for an elevator system.

Referring now to FIG. 2, a partial cross-sectional view of an exemplary load bearing member or belt 30 is illustrated. The belt 30 includes a traction surface 32 interactive with the traction sheave 18, and a back surface 34 opposite the traction surface 32 and defining a belt thickness 36 therebetween. The belt 30 further includes two end surfaces 38 (one shown in the partial cross-section of FIG. 2) extending between the traction surface 32 and the back surface 34 and defining a belt width 40 therebetween. In some embodiments, the belt 30 has an aspect ratio of belt width 40 to belt thickness 36 that is greater than one.

The belt 30 includes plurality of tension members 42 extending along the belt 30 length and arranged across the belt width 40. In some embodiments, the tension members 42 are equally spaced across the belt width 40. The tension members 42 are at least partially enclosed in a jacket material 44 to restrain movement of the tension members 42 in the belt 30 and to protect the tension members 42. The jacket material 44 defines the traction surface 32 configured to contact a corresponding surface of the traction sheave 18. Exemplary materials for the jacket material 44 include, without limitation, the elastomers of thermoplastic and thermosetting polyurethanes, polyamide, thermoplastic polyester elastomers, thermosetting elastomers, thermoplastic elastomers, fluorosilicone rubber, silicone rubber, fluoroelastomer, and other rubbers, for example. Other materials may be used to form the jacket material 44 if they are adequate to meet the required functions of the belt 30. For example, a primary function of the jacket material 44 is to provide a sufficient coefficient of friction between the belt 30 and the traction sheave 18 to produce a desired amount of traction therebetween. The jacket material 44 should also transmit the traction loads to the tension members 42. In addition, the jacket material 44 should be wear resistant and protect the tension members 42 from impact damage, exposure to environmental factors, such as chemicals, for example.

Figure 3:
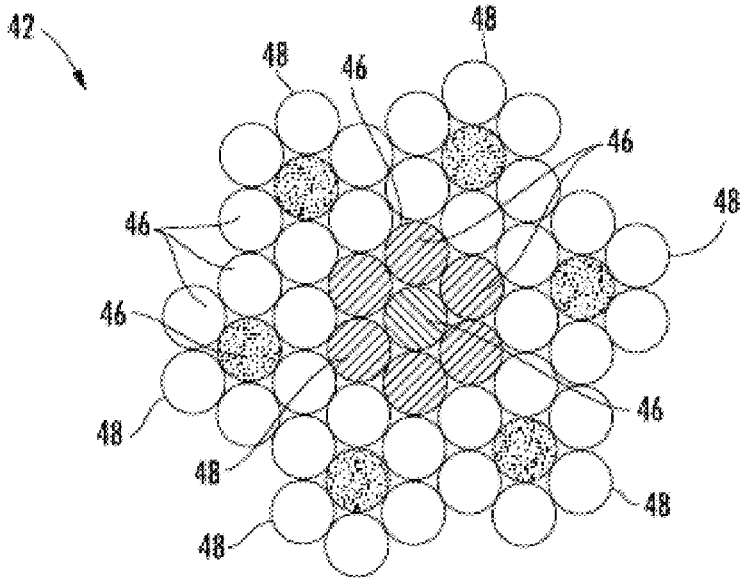
FIG. 3 is a cross-sectional view of an exemplary embodiment of a tension member for a belt.

In some embodiments, as shown in FIGS. 2 and 3, each tension member 42 is formed from a plurality of metallic, for example steel, wires 46, arranged into a plurality of strands 48, which are in turn arranged into a cord, or tension member 42. In other embodiments, the tension members 42 may be formed from other materials and may have other configurations. For example, in some embodiments, the tension member 42 may be formed from a plurality of fibers arranged in a rigid matrix composite. While in the embodiment shown there are six tension members 42 in the belt 30, the number of tension members 42 is merely exemplary. In other embodiments, for example, one, two, three, four, five, seven or more tension members 42 may be utilized. It is to be appreciated that arrangement of wires 46 shown in FIG. 3 is merely exemplary, and that other arrangements of wires 46 to form tension members 42 are contemplated within the scope of the present disclosure.

Figure 4:
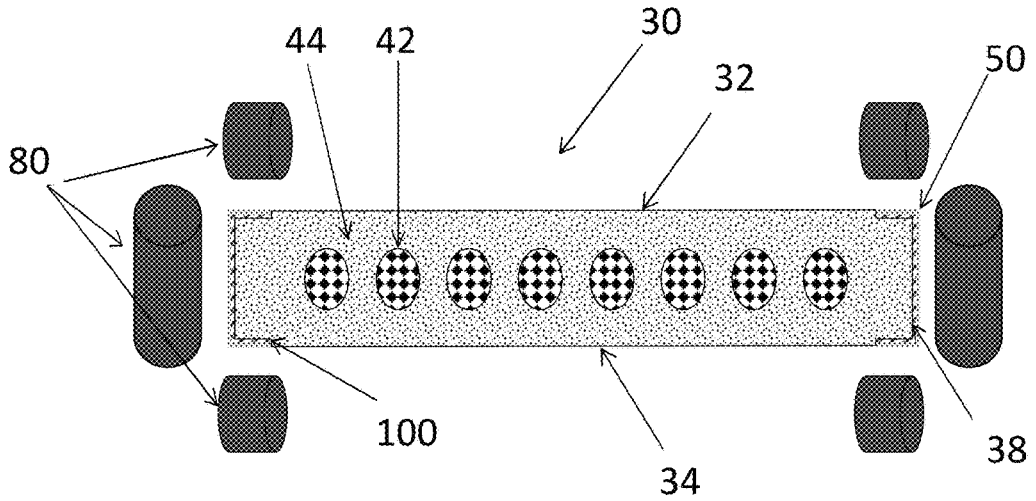
FIG. 4 is a cross-sectional view of an exemplary embodiment of a belt for an elevator system.

Referring now to FIG. 4, fire safety performance of the belt 30 is improved with a metalized polymer coating layer 50 over the jacket material 44 at the end surfaces 38, and in some embodiments wrapping partially around the belt 30 to extend onto the traction surface 32 and/or the back surface 34. In one embodiment, the metalized polymer coating layer 50 may be formed from a material that includes, without limitation, thermoplastic polyurethane, nitrile rubber, polybutadiene rubber, styrene-butadiene rubber, ethylene propylene rubber, ethylene propylene diene rubber, fluorosilicone rubber, silicone rubber, fluoroelastomer, polyethylene terephthalate, polyester, polyolefin, chloroprene, polyvinyl chloride, or other polymers, or thermoplastic elastomers, or thermoset elastomers, or a ductile metal, or the like. In an embodiment, one or more halogenated variations of one or more of the materials listed above at least partially forms part of the coating layer 50. The polymer coating layer 50 may be metalized via vapor deposition or electroless deposition or cold spray deposition or any other suitable method. In one embodiment, the polymer coating layer 50 is metalized with a metal such as aluminum, copper, gold, silver, tin, zinc, or any other ductile metal. In an embodiment, the metalized polymer coating layer 50 includes multiple layers of the same metal and/or multiple layers of different metals.

In one non-limiting example, the metalized polymer coating layer includes a metal layer of a metal that resists corrosion and another metal layer serving a different purpose, such as a zinc-plated steel foil to name one non-limiting example. The thickness of each metal layer of the metalized polymer coating layer 50 is between 1 micrometer and 1000 micrometers in an embodiment, between 5 micrometers and 500 micrometers in another embodiment, and between 10 micrometers and 100 micrometers in another embodiment. The metalized polymer coating layer 50 may be particularly effective in preventing flame propagation around the belt 30 from the traction surface 32 to the back surface 34 or vice versa, via the end surfaces 38.

In some embodiments, the metalized polymer coating layer 50 may extend to cover up to about 40% of the width of the traction surface 32 and/or the back surface 34. In other embodiments, the metalized polymer coating layer 50 may extend to cover between 10% and 20% of the width of the traction surface 32 and/or the back surface 34. In one embodiment, the metalized polymer coating layer 50 may wrap around belt 30 to extend 0.1"-0.4" (2.5-10.2 millimeters) onto the traction surface 32 and/or the back surface 34.

The traction surface 32 and/or the back surface 34 may be shaped prior to application of the metalized polymer coating layer 50 to form step bands 100 over which the metalized polymer coating layer 50 is applied. A depth and width of the step band 100 may be set to match the width and thickness of the metalized polymer coating layer 50 to be applied thereat.

Figure 5:
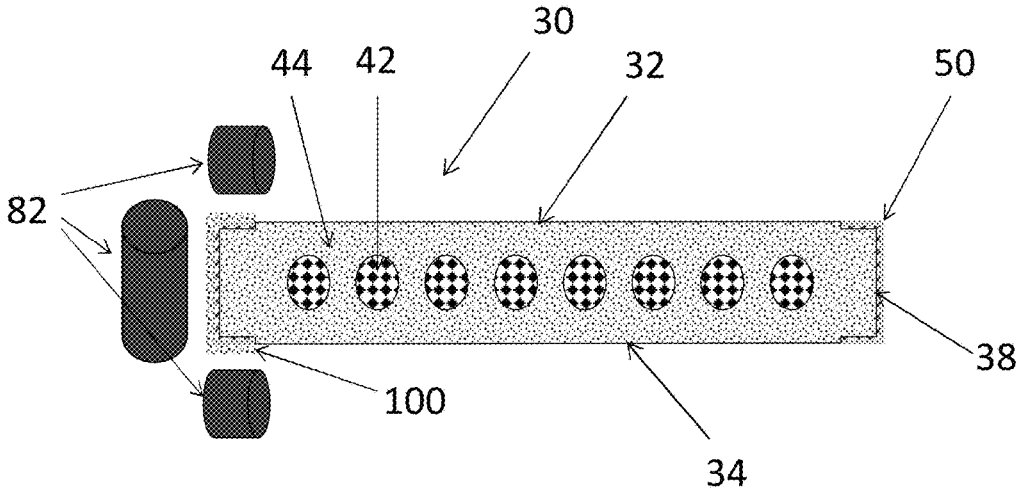
FIG. 5 is a cross-sectional view of an exemplary embodiment of a belt for an elevator system.

In the embodiment shown in FIG. 4, the metalized polymer coating layer 50 may be melt adhered to the jacket material 44 with in-line hot rollers 80. In one embodiment, the metalized polymer coating layer 50 may be applied through lamination. In one embodiment, the metalized polymer coating layer 50 may include a polymer carrier with a high adhesiveness to improve adhesion to the jacket material 44. In the embodiment shown in FIG. 5, the metalized polymer coating layer 50 may be fed through an extrusion die along with the wires 46. In such an embodiment, the metalized polymer coating layer 50 may be cut or ground down with abrasion rollers 82 after cooling to remove excess material from the belt 30.

Figure 6:
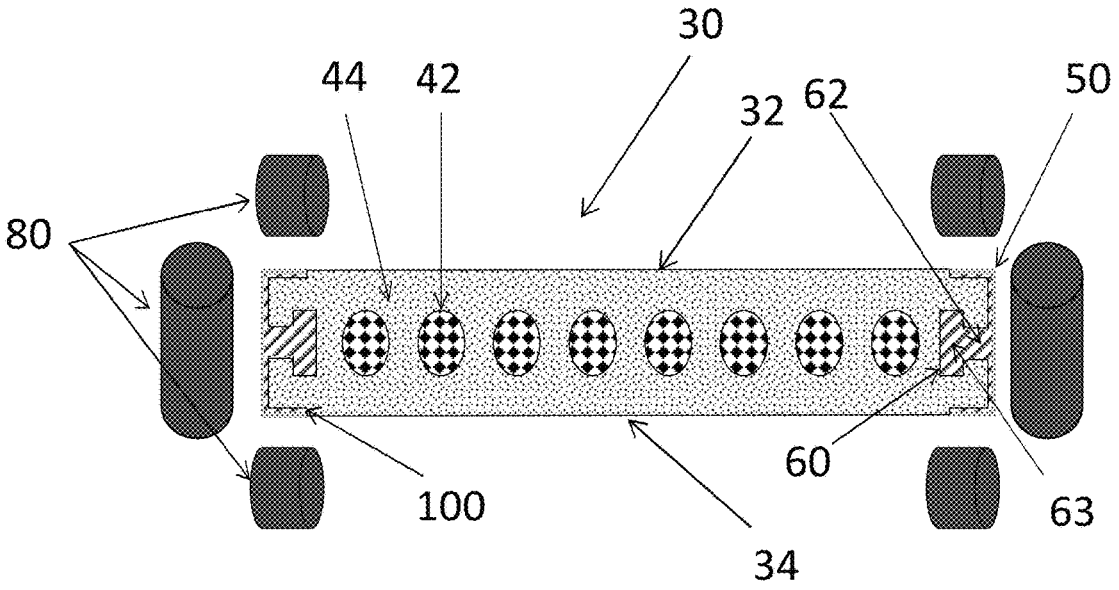
FIG. 6 is a cross-sectional view of an exemplary embodiment of a belt for an elevator system.

In the embodiment shown in FIG. 6, the belt 30 includes a groove 60 formed in the end surfaces 38 of the jacket material 44. In an embodiment wherein the metalized polymer coating layer 50 is adhered to the jacket material 44, the metalized polymer coating layer 50 may be formed with a tongue 62 having tabs 63 that is inserted into the groove 60 during adhesion of the metalized polymer coating layer 50. In an embodiment wherein the metalized polymer coating layer 50 is extruded onto the jacket material 44, the tongue 62 of the metalized polymer coating layer 50 may be injected or melted into the groove 60. The tongue 62 and the groove 60 are constructed and arranged to interlock the metalized polymer coating material 50 to the jacket material 44.

What is claimed is:

1. A belt for an elevator system comprising:

a plurality of tension members arranged along a belt width;

a jacket material at least partially encapsulating the plurality of tension members, the jacket material comprising a traction surface and a back surface opposite the traction surface together defining a belt thickness therebetween, the jacket material further comprising two end surfaces extending between the traction surface and the back surface and defining the belt width therebetween; and two or more metalized polymer coating layers disposed over at least one of the two end surfaces;

wherein the two or more metalized polymer coating layers are further disposed over at least a portion of at least one of the traction surface or the back surface;

wherein at least one of the traction surface or the back surface includes a step band receptive of the two or more metalized polymer coating layers wherein a first metalized polymer coating layer of the two or more metalized polymer coating layers includes a first metal, and a second metalized polymer coating layer of the two or more metalized polymer coating layers includes a second metal different from the first metal.

2. The belt of claim 1, wherein the two or more metalized polymer coating layers comprise at least one of polyurethane, nitrile rubber, polybutadiene rubber, styrene-butadiene rubber, ethylene propylene rubber, ethylene propylene diene rubber, fluoro silicone rubber, silicone rubber, fluoroelastomer, polyethylene terephthalate, polyester, polyolefin, chloroprene, polyvinyl chloride, or other polymer, or thermoplastic elastomer, or thermoset elastomer.

3. The belt of claim 1, wherein the two or more metalized polymer coating layers comprise a ductile metal.

4. The belt of claim 1, wherein the two or more metalized polymer coating layers are applied to the jacket material through melt adhesion.

5. An elevator system comprising:

an elevator car:

a counterweight; and a belt coupling the elevator car to the counterweight, the belt comprising:

a plurality of tension members arranged along a belt width;

a jacket material at least partially encapsulating the plurality of tension members, the jacket material comprising a traction surface and a back surface opposite the traction surface together defining a belt thickness therebetween, the jacket material further comprising two end surfaces extending between the traction surface and the back surface and defining the belt width therebetween; and two or more metalized polymer coating layers disposed over at least one of the two end surfaces;

wherein the two or more metalized polymer coating layers are further disposed over at least a portion of at least one of the traction surface or the back surface;

wherein at least one of the traction surface or the back surface includes a step band receptive of the two or more metalized polymer coating layers wherein a first metalized polymer coating layer of the two or more metalized polymer coating layers includes a first metal, and a second metalized polymer coating layer of the two or more metalized polymer coating layers includes a second metal different from the first metal.

6. The elevator system of claim 5, wherein the two or more metalized polymer coating layers comprise at least one of polyurethane, nitrile rubber, polybutadiene rubber, styrene-butadiene rubber, ethylene propylene rubber, ethylene propylene diene rubber, fluoro silicone rubber, silicone rubber, fluoroelastomer, polyethylene terephthalate, polyester, polyolefin, chloroprene, polyvinyl chloride, or other polymer, or thermoplastic elastomer, or thermoset elastomer.

7. The elevator system of claim 5, wherein the two or more metalized polymer coating layers comprise a ductile metal.

8. The elevator system of claim 5, wherein the two or more metalized polymer coating layers are applied to the jacket material through melt adhesion.

* * * * *